US006061670A

United States Patent [19]

Brand

[11] Patent Number: 6,061,670

[45] Date of Patent: May 9, 2000

[54] MULTIPLE REGISTERED POSTAGE METERS

[75] Inventor: Patrick M. Brand, Southport, Conn.

[73] Assignee: Pitney Bowes Inc., Stamford, Conn.

[21] Appl. No.: 08/993,310

[22] Filed: Dec. 18, 1997

[51] Int. Cl.[7] ..... G07B 17/00

[52] U.S. Cl. ..... 705/404; 705/408

[58] Field of Search ..... 705/400, 404, 705/408, 410

[56] References Cited

U.S. PATENT DOCUMENTS

| | | | |
|---|---|---|---|
| 4,760,532 | 7/1988 | Sansone et al. | 705/403 |
| 4,802,218 | 1/1989 | Wright et al. | 380/23 |
| 4,837,701 | 6/1989 | Sansone et al. | 705/404 |
| 4,934,846 | 6/1990 | Gilham | 700/104 |
| 4,958,291 | 9/1990 | Mamone et al. | 705/404 |
| 5,029,093 | 7/1991 | Wiener | 364/464.02 |
| 5,077,792 | 12/1991 | Herring | 380/24 |
| 5,177,680 | 1/1993 | Tsukino et al. | 364/401 |
| 5,375,172 | 12/1994 | Chrosny | 380/51 |
| 5,388,211 | 2/1995 | Hornbuckle | 395/200 |
| 5,485,579 | 1/1996 | Hitz et al. | 395/200.12 |
| 5,490,077 | 2/1996 | Freytag | 705/405 |
| 5,513,112 | 4/1996 | Herring et al. | 364/464.02 |
| 5,526,271 | 6/1996 | Abumehdi | 364/464.02 |
| 5,602,743 | 2/1997 | Freytag | 705/408 |
| 5,682,427 | 10/1997 | Seestrom | 380/51 |
| 5,717,596 | 2/1998 | Bernard et al. | 705/404 |
| 5,781,438 | 7/1998 | Lee et al. | 705/404 |
| 5,812,991 | 9/1998 | Kara | 705/410 |
| 5,822,739 | 10/1998 | Kara | 705/410 |
| 5,946,671 | 8/1999 | Herring | 705/404 |

FOREIGN PATENT DOCUMENTS 2138103 6/1995 Canada .

*Primary Examiner*—Edward R. Cosimano
*Attorney, Agent, or Firm*—Charles R. Malandra, Jr.; Michael E. Melton

[57] ABSTRACT

A system and method of evidencing postage payment includes selecting a postal origin in a meter accounting unit, selecting a requested postal value to be printed on a mailpiece, deducting the requested postal value from a total postal value stored as a general account for the meter accounting unit, adding the requested postal value to a sub-account corresponding to the selected postal origin for the meter accounting unit, and printing the requested postal value and the selected postal origin on the mailpiece. A digital token is generated as evidence of the requested postal value to be printed on the mailpiece. The digital token, which is also printed on the mailpiece, is encrypted information including the requested postal value and the selected postal origin. The accounting unit includes a first processor, secure accounting process, value storage and a digital signature generator. The value storage includes total postal value information and an origin postal value for each of a plurality of postal origins, wherein the PSD is authorized to dispense evidence of postage payment for each of the postal origins. The accounting unit performs accounting for each postage evidencing transaction, debiting the total postal value and incrementing one of the origin of postal values corresponding to the postage evidencing transaction.

14 Claims, 4 Drawing Sheets

MULTIPLE REGISTERED POSTAGE METERS

RELATED APPLICATIONS

The present application is related to the following U.S. patent applications Ser. Nos. 08/993,356 and 08/993,357, all filed concurrently herewith and assigned to the assignee of the present invention.

FIELD OF THE INVENTION

The present invention relates generally to a postage metering system and method for printing postage indicia using digital printing meters and, more particularly, to a postage metering system and method for printing postage indicia using closed and open system printing devices.

BACKGROUND OF THE INVENTION

Presently, there are two postage metering device types: closed systems and open systems. In a closed system, the system functionality is solely dedicated to metering activity. Examples of closed system metering devices, also referred to as postage evidencing devices, include conventional digital and analog (mechanical and electronic) postage meters wherein a dedicated printer is securely coupled to a metering or accounting function. In a closed system, since the printer is securely coupled and dedicated to the meter, printing evidence of postage cannot take place without accounting for the evidence of postage. In an open system, the printer is not dedicated to the metering activity, freeing system functionality for multiple and diverse uses in addition to the metering activity. Examples of open system metering devices include personal computer (PC) based devices with single/multi-tasking operating systems, multi-user applications and digital printers. An open system metering device is a postage evidencing device with a non-dedicated printer that is not securely coupled to a secure accounting module. Open system indicia printed by the non-dedicated printer is made secure by including addressee information in the encrypted evidence of postage printed on the mailpiece for subsequent verification.

Conventional closed system mechanical and electronic postage meters have heretofore secured the link between printing and accounting. The integrity of the physical meter box has been monitored by periodic inspections of the meters. Digital printing postage meters, which are closed system postage meters, typically include a digital printer coupled to a metering (accounting) device, which is referred to herein as a postal security device (PSD). Digital printing postage meters have removed the need for physical inspection by cryptographically securing the link between the accounting and printing mechanisms. In essence, new digital printing postage meters create a secure point to point communication link between the accounting unit and printhead. See, for example, U.S. Pat. No. 4,802,218, issued to Christopher B. Wright et al and now assigned to the assignee of the present invention. An example of a digital printing postage meter with secure printhead communication is the PERSONAL POST OFFICE™ manufactured by Pitney Bowes Inc. of Stamford, Conn. An example of a digital printing postage meter in a secure housing is the PostPerfect™ also manufactured by Pitney Bowes Inc. of Stamford, Conn.

In even a modest size mailroom it is common that several meters are present. It has been shown that funds can be stored in one central location for batch mailing purposes where evidence of postage payment for batch mail printed at several printers is evidenced through the printing of a statement summarizing the postage for the batch of mail. See U.S. Pat. Nos. 4,760,532 and 4,837,701, each assigned to the assignee of the present invention. However, this scheme has limitations. First, the scheme is limited to batch mail processing without evidencing (franking) postage on each mailpiece. In addition, in large mailrooms it is common for mail to be processed for several different originating zip codes. Since each meter is assigned one originating zip code, meters are frequently moved from one mailing machine to another depending upon the mail processing needs.

In U.S. Pat. No. 4,837,701, a mail processing system is disclosed for processing batch mail utilizing a plurality of work stations, such as inserters. In U.S. Pat. No. 4,760,532, a mail processing system is disclosed for processing batch mail utilizing a single work station. However, in each case postage is evidenced by printing an accounting statement containing information accumulated during the processing of the batch of mailpieces. The accounting statement is a summary of the type and number of mailpieces processed and the amount of postage for the entire batch. Thus, in U.S. Pat. Nos. 4,760,532 and 4,837,701 the postage for each mailpiece is not evidenced on the mailpiece but by the accounting statement that must accompany the batch of mail when deposited with the post. The accounting statement is printed by a printer that is different than the printer used to prepare the mailpieces.

In U.S. Pat. No. 5,682,427, a postage metering system with dedicated and non-dedicated printing means is disclosed. However, in this postage metering system only the non-dedicated printer prints evidence of postage. The dedicated printer is part of a digital postage meter that is coupled to the processor that controls the non-dedicated printer. The digital postage meter is present solely to provide the processor and ultimately the non-dedicated printer with the encrypted information that is printed as evidence of postage. Since addressee information is included in the encrypted information, the non-dedicated printer prints open system evidence of postage.

Heretofore, each metering device or accounting unit of a postage metering system has a single origin of deposit, i.e. has been registered at a single post office. The postage funds stored in each metering device has been credited (deposited) for the account of the single post office, which is expected to be handling all mailpieces containing indicia printed by the metering device registered thereto. Thus, for companies or mailrooms requiring different origins of deposit for processing mailpieces, multiple meters have been needed to achieve such multiple origins of deposit.

It is the current practice for a mailer who wishes to deposit mail in several post offices to have a separate meter for each post office. Sufficient funds must be placed in each meter to pay postage for mail deposited at the corresponding post office. If the meters use a conventional meter refill process, such as the POSTAGE BY PHONE® service provided by the Pitney Bowes Inc. of Stamford, Conn., then the mailer must make separate refill calls for each meter. Further, once the funds are placed in a meter, they cannot easily be withdrawn. This results in difficulties for mailers who do not necessarily know in advance how much mail they wish to deposit at each post office.

SUMMARY OF THE INVENTION

It has been found that an accounting process can be implemented in a postage metering device that allows the postage metering device to be registered at several different post offices. In accordance with the present invention, the postage metering device is registered at each post office where the customer wishes to deposit mail, and contains a national Postal Service register and separate sub-registers for each post office to which it is registered.

In accordance with the present invention, funds are transferred to a national Postal Service register in the postage metering device during postage refill for the postage metering device. As required those funds are transferred within the postage metering device to a one of a plurality of sub-registers representing one of the several different post offices when franking occurs with an origin of deposit for a particular post office. At the next postage refill transaction for the postage metering device the total internal transfers to each local post office sub-registers are reported to the refill Data Center, which reports the same to the Postal Service. The Postal Service may then account postage refill funds transfer to the appropriate post office. When franking each mailpiece, the postage metering device prints an origination postal code corresponding to an appropriate post office as part of a digital indicia printed on the mailpiece.

In the present invention, a single postage metering device, also referred to herein as a postal security device (PSD) that performs funds accounting and digital token calculations for multiple origins of deposit. A digital token is encrypted information (such as postage value, date and PSD identification) that authenticates the information imprinted on a mailpiece for authentication of the postage evidencing. The PSD contains all necessary hardware and software to perform all postage metering functions with the exception of printing, with a connection port for communication with a printer coupled thereto or with printers on a network. The printers can either be open or closed printers which initiate requests to the PSD for digital tokens. The PSD provides a response including the digital tokens to be printed on the mailpiece.

The PSD can be refilled upon command from the user or be preset to refill when the balance drops below a particular level. In the preferred embodiment, the PSD keeps a log of how much postage was used by each accountable zip code and this information is sent securely to a Data Center during a funds refill so that the proper postal accounts can be credited for the mail generated.

In one embodiment of the present invention a closed metering system is implemented on a conventional local or wide area network (including infrared and RF networks) to form a "Network Metering System". The Network Metering System includes a plurality of printer modules operatively coupled to one or more PSDs as part of the network. This embodiment is described in previously noted U.S. patent applications Ser. Nos. 08/993,356 and 08/993,357 which are incorporated herein in their entirety by reference concerning such network metering systems.

There are several benefits that are realized from the present invention. One such benefit relates to the postal regulations requiring that the postage printed on a metered mailpiece must be obtained from a meter licensed from the local post office at which the mailpiece is deposited for mailing, commonly referred to as "origin of deposit" or "domain". With a single PSD having a plurality of sub accounting registers accessible over a network, a user at a printer module is not limited to a "single" PSD having a single origin of deposit or domain. For example, while most meters of a network metering system may be configured to deposit their mailpieces in the Post Office in Shelton, Conn., other meters may be configured to deposit their mailpieces at different origins of deposit, such as New Haven, Conn. Furthermore, a printer module that is physically connected to a PSD in Shelton, Conn., may be processing mail to be deposited in New Haven, Conn. Since the New Haven acceptance mail facility is open later than the Shelton Facility. The present invention provides each printer module on the network with access to a central funds accounting register having several origins of deposit within the same PSD.

The present invention provides a system and method of evidencing postage payment that includes selecting a postal origin for in a meter accounting unit, selecting a requested postal value to be printed on a mailpiece, deducting the requested postal value from a total postal value stored as a general account for the meter accounting unit, adding the requested postal value to a sub-account corresponding to the selected postal origin for the meter accounting unit, and printing the requested postal value and the selected postal origin on the mailpiece. A digital token is generated as evidence of the requested postal value to be printed on the mailpiece. The digital token, which is also printed on the mailpiece, is encrypted information including the requested postal value and the selected postal origin. The accounting unit includes a first processor, secure accounting process, value storage and a digital signature generator. The value storage includes total postal value information and an origin postal value for each of a plurality of postal origins, wherein the PSD is authorized to dispense evidence of postage payment for each of the postal origins. The accounting unit performs accounting for each postage evidencing transaction, debiting the total postal value and incrementing one of the origin of postal values corresponding to the postage evidencing transaction.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PRESENT INVENTION

In accordance with the present invention, a meter (or PSD) is registered at several (N) different post offices ($PO_1$, $PO_2$ . . . $PO_N$). The meter has an internal sub-registers ($RPO_1$, $RPO_2$ . . . $RPO_N$) corresponding to each post office for which the meter is authorized. The meter further has a register (RNPS) for the national Postal Service. When the customer makes a refill call, the meter reports the status of each RPO register to the refill Data Center. The customer requests funds transferred to the RNPS register. The funds are transferred by a refill transaction to the national postal service register. Reports of the registers ($RPO_1$, $RPO_2$ . . .

$RPO_N$) are reported from the refill Data Center to the national Postal Service to allow the Postal Service to account for postage at each local post office. The register RNPS may have ascending and descending registers. The RPO registers may simply be a total of postage evidenced for mail destined for the corresponding post office.

Figure 1:
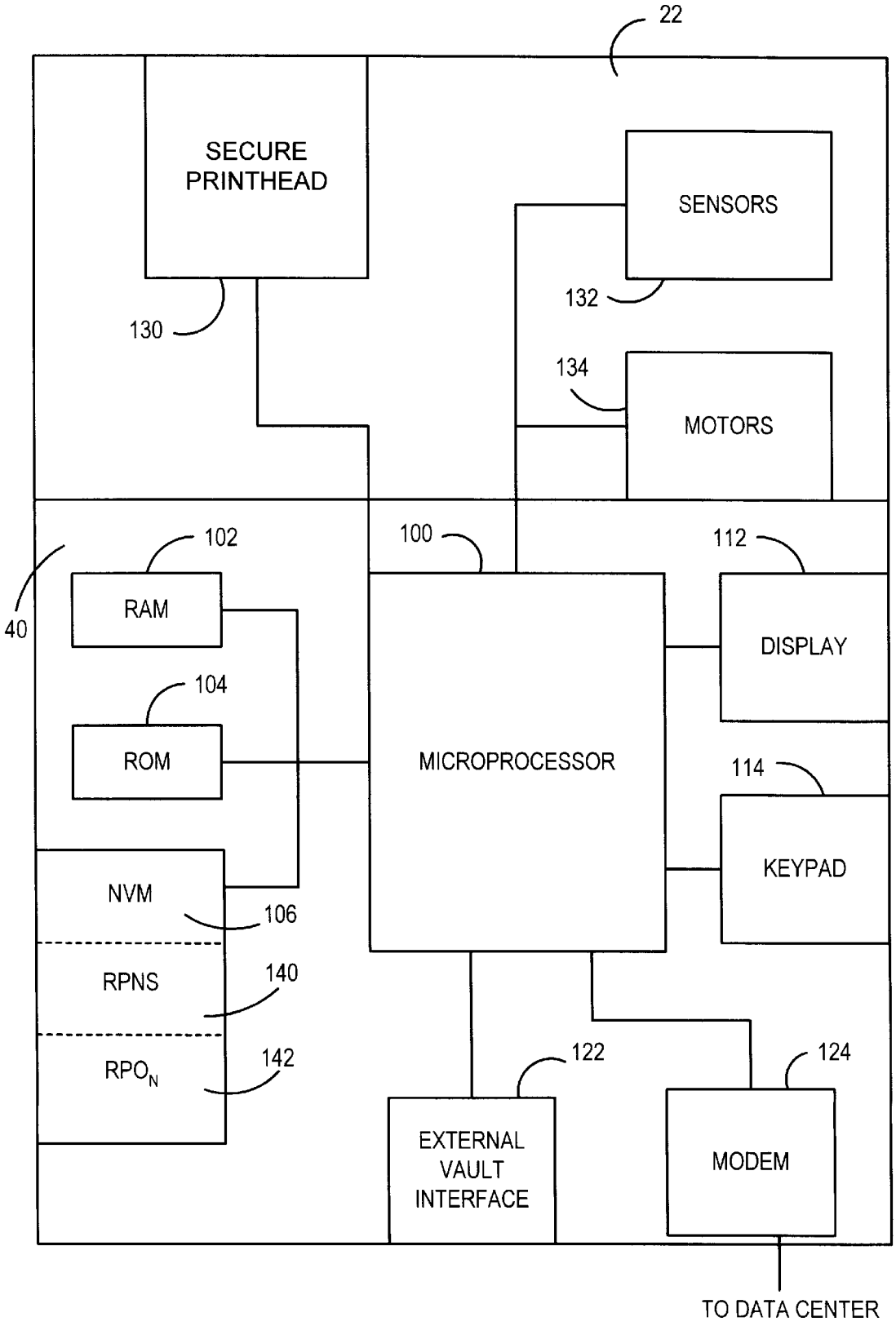
FIG. 1 is a block diagram of the PSD coupled to a dedicated printer.

In describing the present invention, reference is made to the drawings, wherein there is seen in FIG. 1 a PSD 40 coupled to a dedicated metering printer module 22. However, it will be understood that the present invention is suitable for both open and closed postage metering systems. A PSD 40 includes a microprocessor 100 coupled to memory modules RAM 102, ROM 104 and non-volatile memory (NVM) 106 and to user interface modules display 112 and keypad 114. PSD 40 further includes an external vault interface 122 and a modem 124. ROM 104 contains the operating programs for performing accounting and cryptographic functions. NVM 106 stores transaction and accounting logs for the PSD 40, network ID for the PSD 40, and the registers RPNS 140 and $RPO_N$ 142. Communications to a Data Center 5 (FIGS. 1 and 2) are made through modem 124. Printer 22 includes a secure printhead 130, sensors 132 for sensing printing functions, and motors 134 for activating printer functions and controlling the flow of mailpieces through the system. Printer 22 is coupled to PSD 40 in a conventional manner, whereby microprocessor 100 controls printhead 130.

The printers may be unsecured or may be securely coupled as described in U.S. patent application Ser. No. 08/864,929, filed May 29, 1997, entitled SYNCHRONIZATION OF CRYPTOGRAPHIC KEYS BETWEEN TWO MODULES OF A DISTRIBUTED SYSTEM and assigned to the assignee of the present invention, or in U.S. Pat. No. 4,802,218, issued to Christopher B. Wright et al and now assigned to the assignee of the present invention.

In accordance with the present invention a method is provided wherein one set of master postal registers is maintained in PSD 40 and multiple accounting sub-registers for each origin of mailing are maintained in PSD 40. This method allows a request for evidence of postage to include an origin of mailing other than the origin of mailing for the master postal register of the PSD. The sub-registers are sent to the Data Center at time of refill. At that time, the Data Center sends accounting information to the appropriate Postal Service for proper crediting of postal accounting centers.

Figure 2:
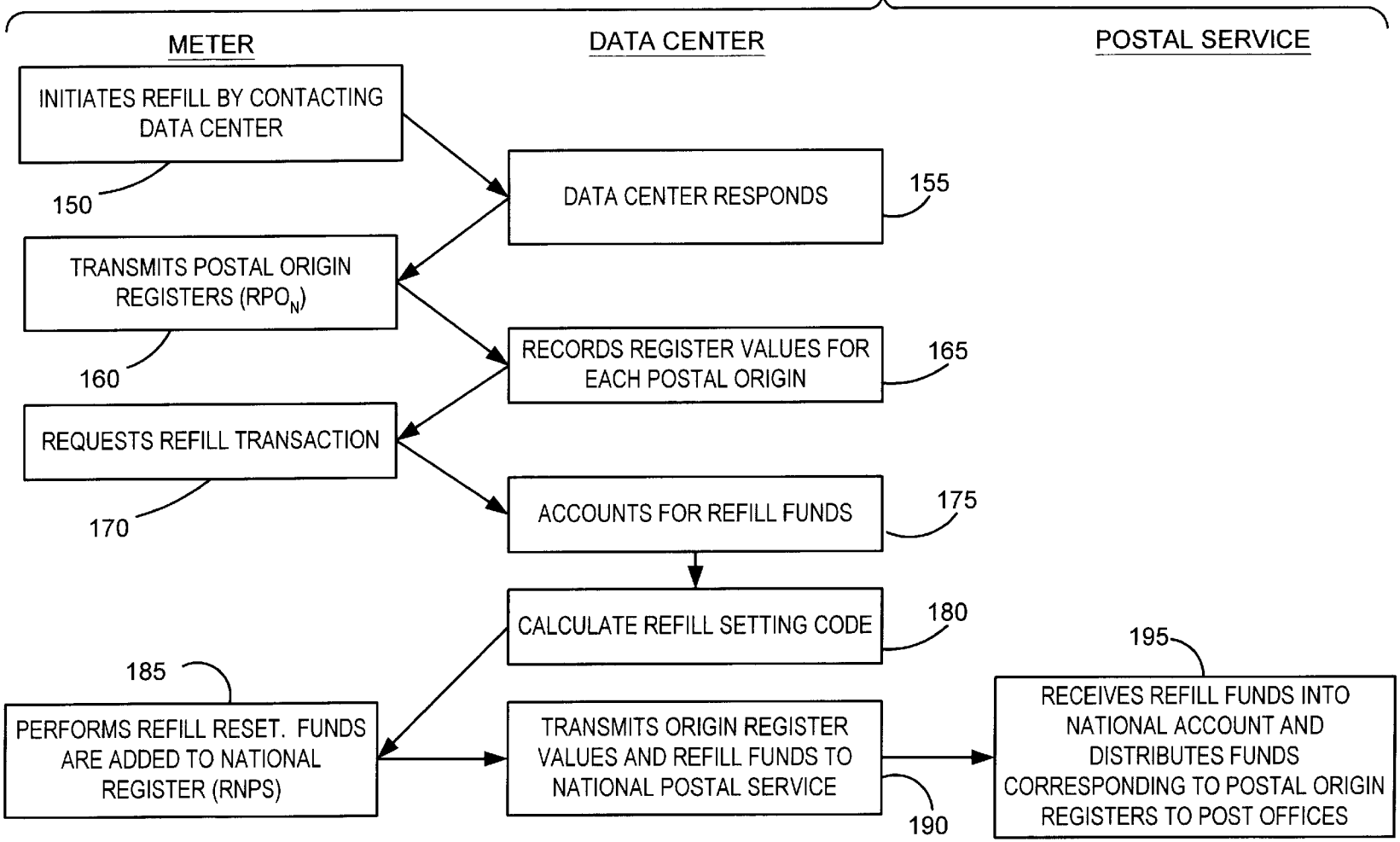
FIG. 2 is a flow chart of the process for distributing funds in accordance with the present invention.

Referring now to FIG. 2, the process for distributing funds in accordance with the present invention begins at step 150, with the meter or PSD placing a call for refill of postal funds. At step 155, the Data Center responds to the request, and, at step 160, the meter transmits the sub-registers $RPO_N$ to the Data Center. At step 165, the Data Center records the register values for each post office corresponding to each $RPO_N$ and sends an acknowledgment to the meter. At step 170, the meter requests the refill transaction. At step 175, the Data Center verifies that user's account has sufficient funds for the refill request and then accounts for the requested amount for the refill. At step 180, the Data Center calculates a refill setting code which allows the meter to complete the refill and transmits the setting code to the meter. At step 185, the meter performs refill reset wherein the funds requested are added to the national account RNPS register and sends an acknowledgment to the Data Center that the refill has been completed. At step 190, the Data Center transmits the sub-register value for each post office and the total refill funds to the national Postal Service. At step 195, the national Postal Service receives the total refill funds into the national account and distributes the funds of the sub-register values to appropriate post offices.

Figure 3:
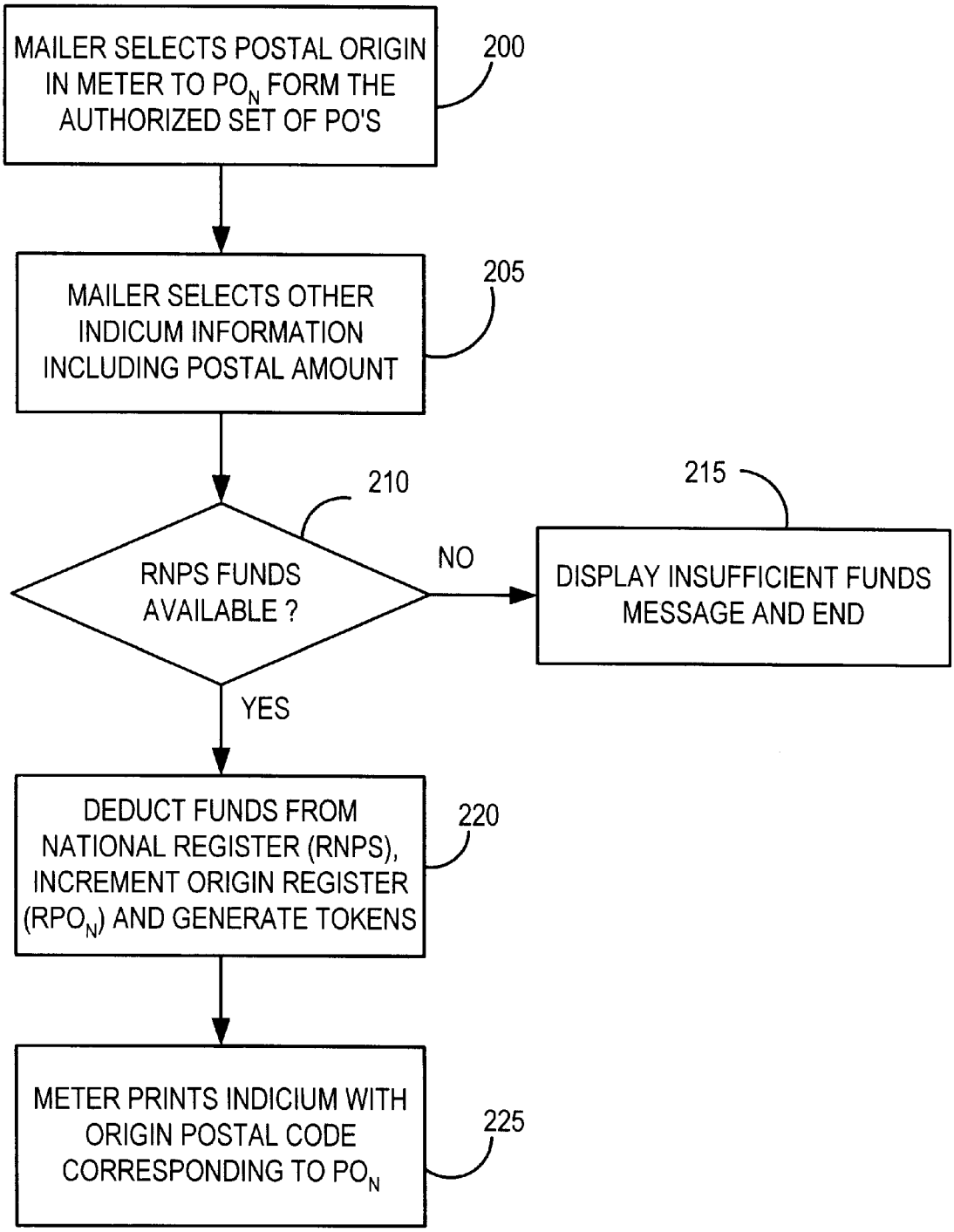
FIG. 3 is a flow chart of the process for evidencing postage in accordance with the present invention.

Referring now to FIG. 3, the procedure for evidencing postage in accordance with the present invention is shown. At step 200, a mailer selects a postal origin in the meter for a particular post office ($PO_N$) from an authorized set of post offices (PO). At step 205, the mailer selects other indicia information including postage amount. At step 210, the meter accounting unit verifies that the national register contains sufficient funds stored therein. If not, then at step 215, the meter displays an insufficient funds message. If sufficient funds are available, then at step 220, the meter deducts funds from the national account register and increments the appropriate postal origin register and generates a digital token. At step 225, the meter prints an indicium with the origin postal code corresponding to the particular post office ($PO_N$).

Figure 4:
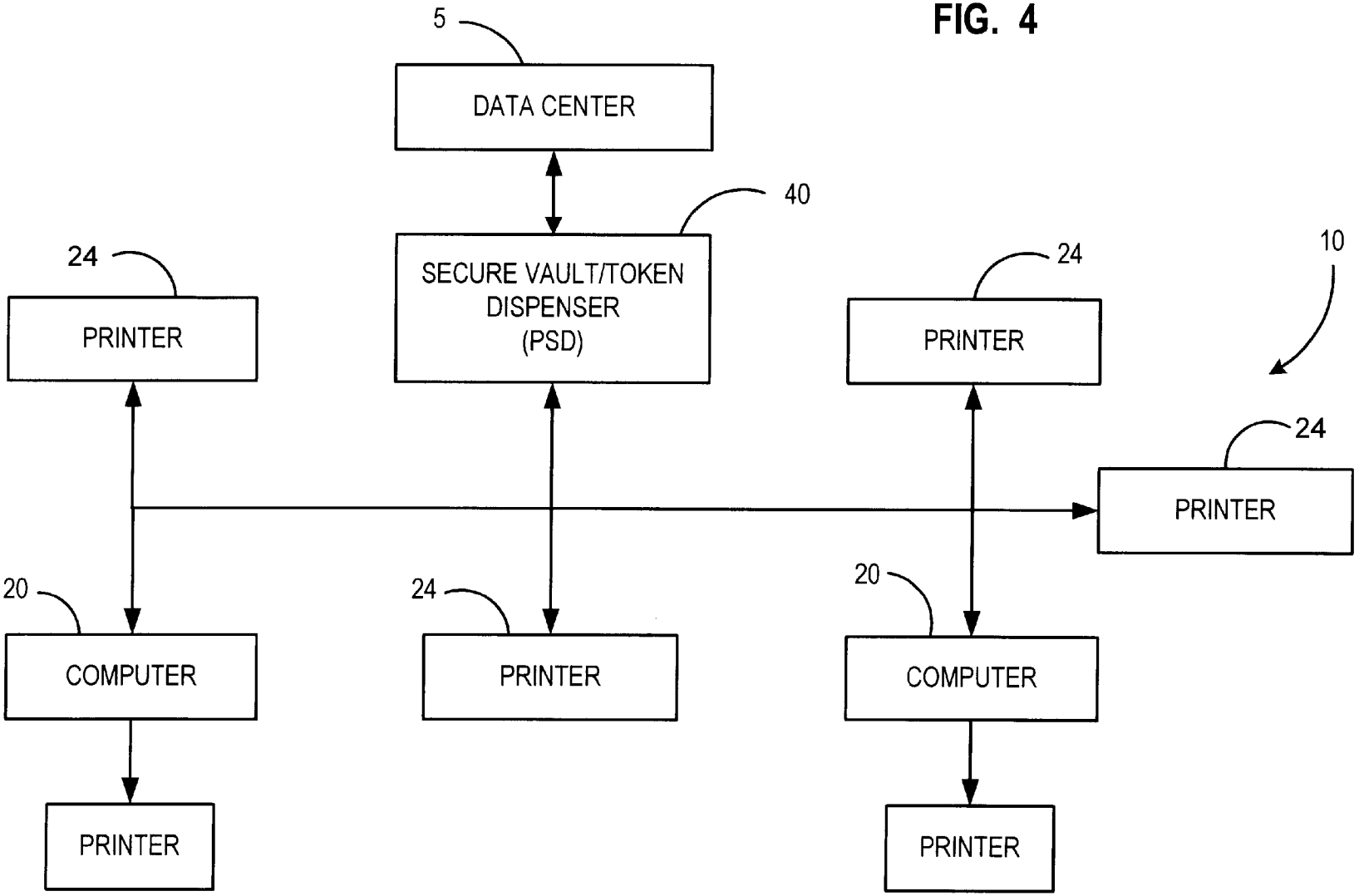
FIG. 4 is a block diagram of a Network Metering System with a PSD coupled to a plurality of dedicated and/or non-dedicated printers on a network in accordance with the preferred embodiment of the present invention.

Referring now to FIG. 4, a network metering system, generally designated 10, is shown. The network metering system 10 includes a plurality (six are shown) of printer modules conventionally coupled to a PSD 40 directly connected to a network. Two of the printer modules are non-dedicated printers 22 coupled to personal computers 20 which are coupled to the network. Four of the printer modules are digital printers that are dedicated devices 24, such as mailing machines, which are dedicated to printing postage indicium and meter or PSD related information, such as refill receipts and inspection cards. Each dedicated printer module 22 (shown in more detail in FIG. 3) resembles a conventional digital metering system with optional display, keyboard, and an printer, except that the printer modules do not have an accounting module or PSD attached thereto. The PSD 40 is an accounting module similar to accounting units in conventional electronic postage meters. When evidence of postage payment is needed, printer modules 22 and 24 request the evidence of postage payment directly from PSD 40. PSD 40 also has an optional modem to connect to Data Center 5. The connection can also be made through computer 20 or the printer module's modem.

It is noted that the preferred embodiment of the present invention has been described for stand-alone metering systems and printer devices residing within a local area network (LAN). However, it has been found that open and closed systems can be served by a remote token dispenser over a wire. See, for example, U.S. Pat. No. 5,953,427 and U.S. patent application Ser. No. 08/993,358. Thus, the present invention applies can be extended to a closed system virtual meter.

It will be understood that although the embodiments of the present invention are described as postage metering systems, the present invention is applicable to any value metering system that includes transaction evidencing, such as monetary transactions, item transactions and information transactions. While the present invention has been disclosed and described with reference to embodiments thereof, it will be apparent, as noted above, that variations and modifications may be made therein. It is, thus, intended in the following claims to cover each variation and modification that falls within the true spirit and scope of the present invention.

What is claimed is:

1. A method of evidencing postage payment, the method comprising the steps of:

selecting a postal origin in a meter accounting unit;

selecting a requested postal value to be printed on a mailpiece;

deducting the requested postal value from a total postal value stored as a general account for the meter accounting unit;

adding the requested postal value to a sub-account corresponding to the selected postal origin for the meter accounting unit; and printing the requested postal value and the selected postal origin on the mailpiece.

2. The method of claim 1 comprising the further steps of:

generating a digital token as evidence of the requested postal value to be printed on the mailpiece, said digital token being encrypted information including the requested postal value and the selected postal origin; and printing the digital token on the mailpiece.

3. A method of refilling a postage meter with postal funds, the method comprising the steps of:

providing a postage meter with a general accounting register corresponding to total postal value stored in the postage meter;

authorizing the postage meter for printing evidence of postage payment for a plurality of postal origins, each of the postal origins corresponding to respective post offices;

providing the postage meter with a plurality of sub-accounting registers, each of the sub-accounting registers corresponding to an amount of postal value printed for one of the plurality of postal origins since an immediately previous meter refill by the postage meter;

requesting a new meter refill from a data center;

sending to a data center controlling the new meter refill the amount of postal value in each of the sub-accounting registers;

accounting at the data center the amount requested for the new refill;

sending the amount of postal value in each of the sub-accounting registers to a postal service;

distributing to the respective post offices funds corresponding to the amount of postal value in each of the sub-accounting registers.

4. A postage metering system comprising:

a postal security device (PSD) including a first processor, secure accounting means, value storage means and digital signature means, said value storage means including total postal value information and an origin postal value for each of a plurality of postal origins, wherein the PSD is authorized to dispense evidence of postage payment for each of said postal origins;

a printer module coupled to the PSD, wherein the PSD performs accounting for each postage evidencing transaction, the accounting including debiting the total postal value and incrementing one of the origin of postal values corresponding to the postage evidencing transaction.

5. The system of claim 4 wherein the printer module requests and obtains from the PSD evidence of postage payment for mailpiece to be printed on the mailpiece, the request including postal amount and one of the postal origins.

6. The system of claim 4 wherein the printer module includes printing means dedicated to printing said evidence of postage payment.

7. The system of claim 4 wherein the printer module includes a general purpose processor with an unsecured printer coupled thereto for printing said evidence of postage payment.

8. The system of claim 4 wherein the PSD is communicatively coupled to a remote Data Center for performing conventional metering functions including meter refill.

9. The system of claim 4 wherein said secure accounting means and said value storage means maintain general accounting information for said PSD and specific accounting information for each of said printer modules.

10. The system of claim 4 wherein additional printer modules are connected to the PSD over a network.

11. The system of claim 10 wherein said printer modules include open system and closed system printers.

12. A postage metering system comprises:

a plurality of closed and open meter printer modules operatively connected as part of a metering network;

a postal security device (PSD) coupled to the network, the PSD including a processor, secure accounting means, value storage means and digital signature means, said value storage means including total postal value information and origin postal value for a plurality of postal origins, wherein the PSD is authorized to dispense evidence of postage payment for each of said postal origins;

wherein the printer modules and the PSD function as a postage metering network when one of the printer modules initiates a postage metering transaction by requesting evidence of postage payment from the PSD for concluding the postage metering transaction for one of the postal origins, the PSD receiving the request and performing accounting for the total postal value and for the origin of postal value, the PSD further generating the evidence of postage payment and sending the evidence of payment to the printer module for subsequent printing.

13. The system of claim 12 wherein the PSD is coupled to the network through a personal computer coupled to the network.

14. The system of claim 12 wherein the PSD is coupled to the network through one of the printer modules.

* * * * *